United States Patent [19]

Klingbeil et al.

[11] Patent Number: 4,828,075

[45] Date of Patent: May 9, 1989

[54] ELEVATOR DRIVE CONTROL APPARATUS FOR SMOOTH START-UP

[75] Inventors: Klaus-Jurgen Klingbeil; Horst Woyciel, both of Berlin, Fed. Rep. of Germany

[73] Assignee: Inventio AG, Hergiswil, Switzerland

[21] Appl. No.: 199,166

[22] Filed: May 26, 1988

[30] Foreign Application Priority Data

May 27, 1987 [CH] Switzerland ..... 02046/87

[51] Int. Cl.[4] ..... B66B 1/44

[52] U.S. Cl. ..... 187/115

[58] Field of Search ..... 187/115

[56] References Cited

U.S. PATENT DOCUMENTS 3,614,996 10/1971 Saito et al. ..... 187/115
4,380,275 4/1983 Kahkiputo ..... 187/115
4,738,337 4/1988 Caputo ..... 187/115

FOREIGN PATENT DOCUMENTS 3124018 12/1982 Fed. Rep. of Germany .
53-4947 1/1978 Japan ..... 187/115
56-159705 9/1981 Japan ..... 187/115

*Primary Examiner*—William M. Shoop, Jr.
*Assistant Examiner*—W. E. Duncanson, Jr.
*Attorney, Agent, or Firm*—Marshall & Melhorn

[57] ABSTRACT

An elevator control apparatus suppresses the jerk at the start-up of speed controlled elevator installations in both directions of travel, not only the friction jerk at the transition from the static friction to the sliding friction, but also the imbalance jerk at unbalanced car loads. A set point signal multiplier is connected to the output side of a set point memory in the hoist motor drive control and the set point multiplying factor can be controlled by way of an on/off circuit. The multiplier is switched, prior to the start of the movement, by the on/off circuit to a value greater than one, and is switched back to one at start of movement in the direction of travel. The motor driving force is controlled to a value which, when summed with the imbalance force, is equal to the sliding friction force at start-up. This suppression of jerks is eminently suitable for the refitting of controlled elevator drives and increases, due to the earlier start of movement, their elevating capacity.

12 Claims, 6 Drawing Sheets

ELEVATOR DRIVE CONTROL APPARATUS FOR SMOOTH START-UP

BACKGROUND OF THE INVENTION

The present invention relates to an elevator system in general and, in particular, to an elevator drive control device for smooth start-up.

The conventional elevator system includes a hoisting motor with a driving pulley for carrying out linear motions and devices for the measuring of revolutions and of distances as well as a drive control with a control amplifier, setting means and actual transmitters for the speed and the distance, associated comparators as well as a control device for smooth or jerk-free start-up, where first the suppression of the start-up jerk is controlled and then a control according to preset distance/-speed curves is performed.

The start-up behavior of elevators is an essential criterion for the subjective judging of the feeling of the occupant, which in the start-up phase is determined basically by the acceleration as well as by the acceleration changes and eventual vibrations. In this case, every acceleration of the elevator car and thus that of the passengers results from the superposition of the forces acting in the elevator system according to the formula force (K) equals mass times acceleration. To be considered for the start-up in this connection are: the force of imbalance resulting from the difference between the car load and the counterweight, the braking force of the blocking brake, the friction force resulting from the friction resistances of the movable parts as well as the motor driving force resulting from the starting torque of the hoisting motor. As is generally known, there results during the start-up phase in some of these forces discontinuities in the derivative trend with respect to time. This relates to the braking force, because this force becomes suddenly zero on easing the mechanical blocking brake, as well as to the friction resistances of all movable masses and the transmission components at standstill which are considerably greater than during movement and thus a very sudden change occurs on start-up from standstill. These mechanical discontinuities take place too rapidly to be controlled with the normal drive control. On the contrary, they cause control technological discontinuities and act according to the formula force (K) equals mass times acceleration on the acceleration, which leads to strong changes in the acceleration, leading to "jerks". Elevators of all types of construction tend therefore to generate a "start-up jerk" when starting up from standstill.

In the past, a multitude of devices were proposed in order to eliminate this disagreeable start-up jerk completely or partially and thereby to improve the comfort of travel. In this way, for instance, a device has become known from the German document open for inspection No. 31 24 018 for the addition of weighing data to the control system of an elevator. It is the purpose of this device to compensate the imbalance torque, which acts from the load side at standstill and which is picked up by the blocking brake prior to the start-up by an appropriate motor torque, so that on release of the now relieved blocking brake no "jerky" start-up will take place. As a measure of the imbalance torque, the car load is measured directly and this weighing data impressed on the drive motor by way of the control system. This elevator control system is constructed as an operational amplifier circuit with a velocity control amplifier, the positive terminal of which is connected to ground and at the negative terminal of which the nominal or set point and the actual values of the velocity arrive and at which furthermore a stabilizing resistor and a stabilizing capacitor are connected in series from the negative terminal to the output of the velocity amplifier. For coupling of the weighing data, the stabilizing resistor is bridged by a starting switch and the weighing value conducted with an auxiliary starting switch to the connecting point between the stabilizing resistor and the stabilizing capacitor. With this a jerk-free start-up of the elevator shall be attained, without a separate weighing memory unit with a complex control being necessary.

This device exhibits the basic disadvantage that only one of many different causes of the start-up jerk can be eliminated, that is, the sudden becoming active of the imbalance force on release of the mechanical blocking brake. Another cause for the start-up jerk, that is the unsteady derivative trend with respect to time of the friction resistances during the transition from static friction to sliding friction, cannot be eliminated or alleviated thereby in any way. However, such non-uniformities of friction are increasingly noticeable as start-up jerk in modern systems of low mass and, due to the elastic cable connection between the drive and the elevator car, easily lead to vibrations and oscillations. A further disadvantage of the device shown in German document open for inspection No. 31 24 018 is the fact that expensive load measuring devices are necessary, the accuracy of measurement and long term constancy of which is not sufficient in all cases.

It is here that the invention tends to find a remedy. The proposed invention is therefore based on the problem of suppressing the start-up jerk in elevator installations and thereby improving their travelling comfort. In this case, the suppression of jerks shall be effective in both directions of travel and for any arbitrary loads and at arbitrary values of static and sliding fraction. The suppression of jerks according to the invention shall also be designed in such a manner, that the controlled elevator drives themselves are utilized for the suppression of jerks and that because of this only a modest additional expense will be required.

SUMMARY OF THE INVENTION

A first advantage of the invention can be seen in the fact that by the suppression of the start-up jerk, all the vibrations and oscillations are eliminated which are otherwise triggered by the jerk. This is of particular importance in elevator installations where the car and the drive are not connected rigidly, but are connected elastically by way of long cables and for this reason the whole assembly constitutes a weakly damped system capable of oscillation. A considerable inducement to oscillation for this system is eliminated and thus also the corresponding vibrations and oscillatory processes which delay the start-up procedure in time and would prejudice it with regard to comfort.

Furthermore it has proven to be advantageous, that with the suppression of the jerk according to the invention the time interval between the travel command and the attainment of the nominal velocity is shortened. This gain in time is based on a two-fold economy of time: first the elevator car sets itself in motion earlier, because based on the initially increased nominal travel curb, according to the invention, the time of start-up is attained earlier, and second the subsequent upward travel can be made in the shortest possible time due to the absence of vibrations and building up of transient oscillations. During the start-up therefore no time is lost, which cannot be gained back later. This saving of time is of importance in elevator installations because it increases their conveying capacity.

Additional advantages, realized with the invention according to the proposal, result from the circumstance that for the suppression of the jerk essentially the existing control device can be utilized and that the functions of the suppression of jerk and the control of speed are timewise separated, because first the jerk is being suppressed and only then the speed is controlled. This makes it possible to use the already existing drive control circuit in time multiplex twofold; up to the setting in motion of the elevator car for the suppression of the jerk and afterwards, in customary manner, for the control of the speed. For the suppression of the jerk thus only a modest additional hardware expense in necessary: namely an on/off switch as well as a set point value multiplier. These two circuits are function and not installation related. Thus, they can be constructed the same for every elevator installation. The matching to the friction conditions typical of an elevator installation is performed by the adjustability of the multiplication factor. It is obvious that this offers economic advantages; the expense for manufacture, installation and maintenance is reduced in price and in this way a cost-advantageous solution is obtained. The double utilization of the drive control circuit for the suppression of the jerk and for the velocity control also means that both these function are together function-efficient or fail together. In case of outage of the suppression of jerk therefore no drive is possible and thus also no start-up jerk which would have to be suppressed. Such a suppression of jerk can therefore be said to be fail-safe and exhibits correspondingly a very high reliability. It is also obvious that the earlier mentioned temporary multiplication of the set point value can be installed rapidly and simply into velocity controlled elevator drives. The invention according to the proposal is therefore eminently suitable for refitting customary elevator installations with velocity control with suppression of jerk units and to improve them subsequently in their travel properties.

The invention will be described in the following in its application for the suppression of the start-up jerk in an elevator installation, however the principle forming the basis of this can be applied generally, if masses have to be driven by means of an electronic drive through elastic connecting links, as this is for instance often the case in mechanical conveying and handling in horizontal and vertical transports.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
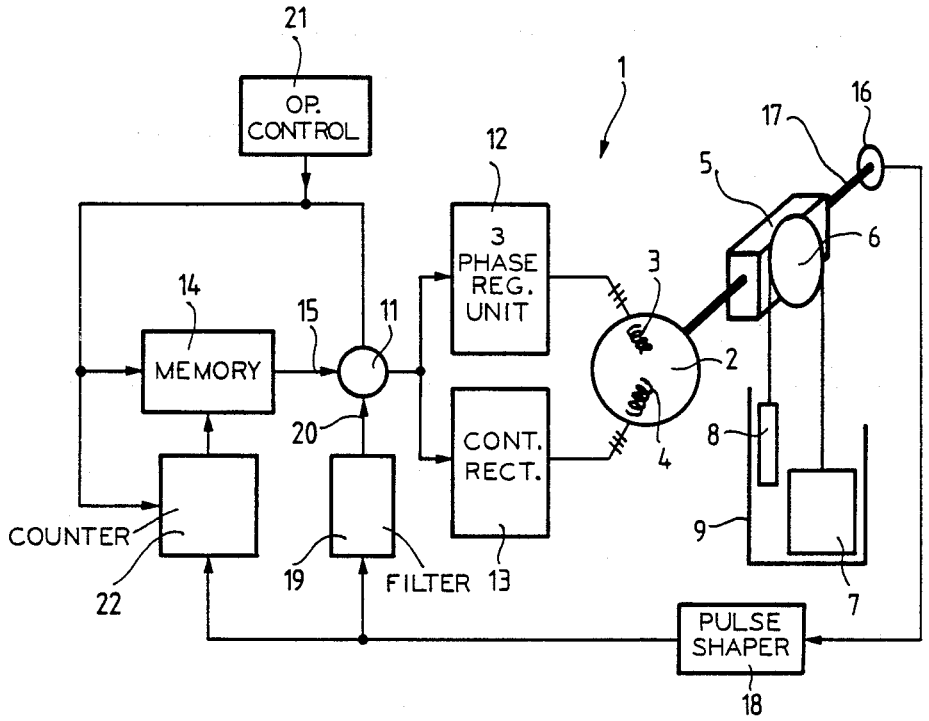
FIG. 1 is a block diagram and partial schematic presentation of a conventional velocity controlled elevator drive.

FIG. 1 shows a conventional three phase drive 1 with a hoisting motor 2 having a high speed winding 3 and a low speed winding 4. An output of the motor 2 is coupled to an input of a worm drive 5 and a driving pulley 6 drives in known manner an elevator car 7 with a counterweight 8 in a shaft 9. The motor 2 is controlled by an analog controller 11, by way of a three phase regulating unit 12 and a controlled rectifier 13. The set point values for the acceleration and deceleration are digitally stored in a set point memory 14 from where they are conducted to a set point input 15 of the analog controller 11. For the detection of the actual number of revolutions of the driving pulley 6, a digital tachometer 16 of the incremental transmitter type is coupled to a worm gear output shaft 17 and connected by way of a pulse shaper 18 and a low-pass filter 19 with a set point input 20 of the analog controller 11. In response to a call, the set point travel curves are generated from the set point memory 14 which is connected with an operating control 21 and a distance counter 22. The distance counter 22, in known manner, forms a car position signal by summing up the pulse frequency, which is proportional to the velocity, and for this is also connected with the pulse shaper 18.

Figure 2:
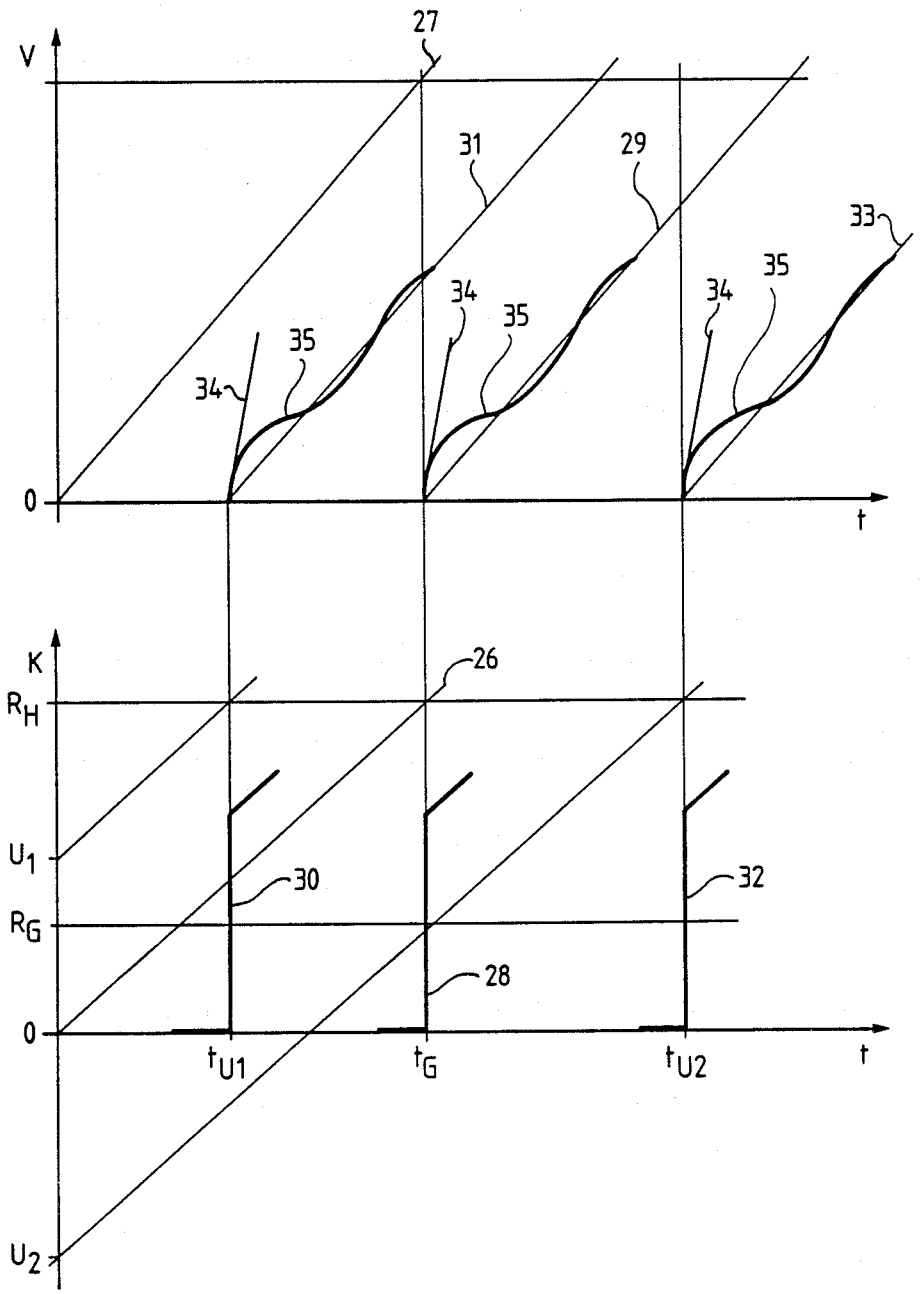
FIG. 2 is a diagram of the driving forces K=F(t) and the car velocity V=F(t) plotted against time for the conventional elevator drive according to FIG. 1.

FIG. 2 comprises a diagram of the progress in time of the forces, as well as the actual start-up curves therefrom, in an elevator system according to FIG. 1, that is without the suppression of jerks. In this diagram, the motor driving force is designated with 26, and the corresponding set point start-up curve with 27. The force of friction is independent of the direction of travel and becomes at standstill the static friction $R_H$, and during motion the sliding friction $R_G$. At a load which is fully balanced by the counterweight there is generated for the resultant driving force diagram 28 and a corresponding actual start-up curve 29 at a time of start-up $t_G$. At an imbalance $U_1$ in the load in the direction of travel, the resultant driving force progresses according to a diagram 30 with an associated start-up curve 31 and at a time of start-up $t_{U1}$. At an imbalance $U_2$ in the load against the direction of travel, a driving force diagram and an actual start-up curve are designated with 32 and 33 respectively, at a time of start-up $t_{U2}$. At the beginning of movement all actual start-up curves 29, 31, 33 have an identical start-up tangent 34 and exhibit about the same damped oscillation trend 35.

Figure 3:
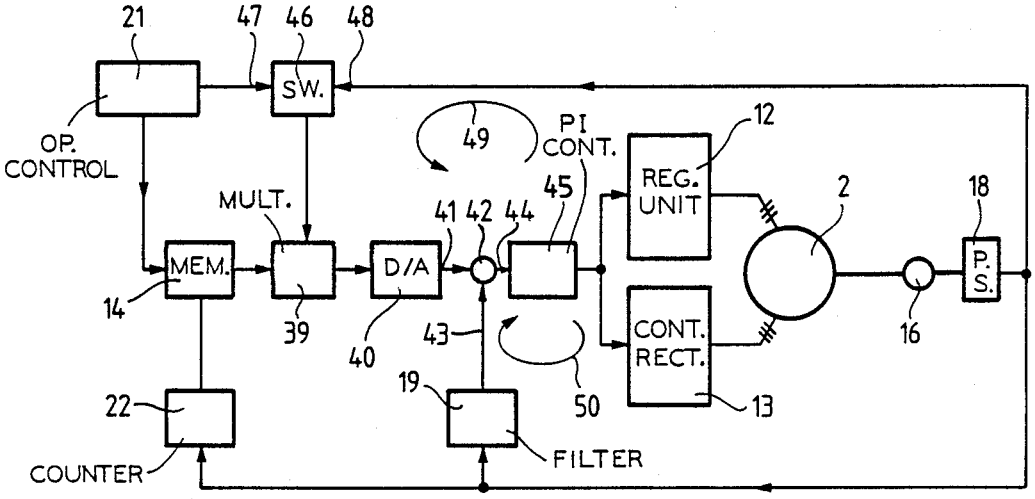
FIG. 3 is a block diagram of a velocity controlled elevator drive including a control device for jerk-free start-up according to the present invention.

The elevator drive equipped with the control device for jerk-free start-up according to the present invention is represented in the block diagram of FIG. 3. As in FIG. 1, a hoisting motor 2 is provided, which is driven by way of a three phase regulating unit 12 and a controlled rectifier 13. The actual speed of revolution of the pulley 6 is detected by a digital tachometer 16 and conducted to the pulse shaper 18, the output of which is conducted to the inputs of the distance counter 22 and the low-pass filter 19. The hoisting motor 2 is controlled with respect to speed, for which purpose set point values forming the set point travel curves are stored digitally in the set point memory 14 as a function of the distance or path. For the interrogation of the set point value, the set point memory 14 is connected with the operating control 21 and the distance counter 22 and is also connected to generate the set point signal from its output by way of a multiplier 39 and a digital-analog converter 40, to a set point input 41 of a comparator 42. Furthermore, there exists a connection each from the output of the low-pass filter 19 to an actual value input 43 of the comparator 42, as well as from an output 44 of the comparater to an input of a PI-controller 45. An on/off switching circuit 46 is controlled at its start input 47 by a start or travel signal from the operating control 21, and at its stop input 48 by the digital tachometer 16 and is connected at its output with the set point value multiplier 39. A first control circuit 49 for the suppression of jerks as well as a second control circuit 50 for the control of the speed are embodied in the circuit elements 14, 39, 40, 42, 45, 12, 2 and 16 which are used twofold in a time multiplexed connection.

Figure 4:
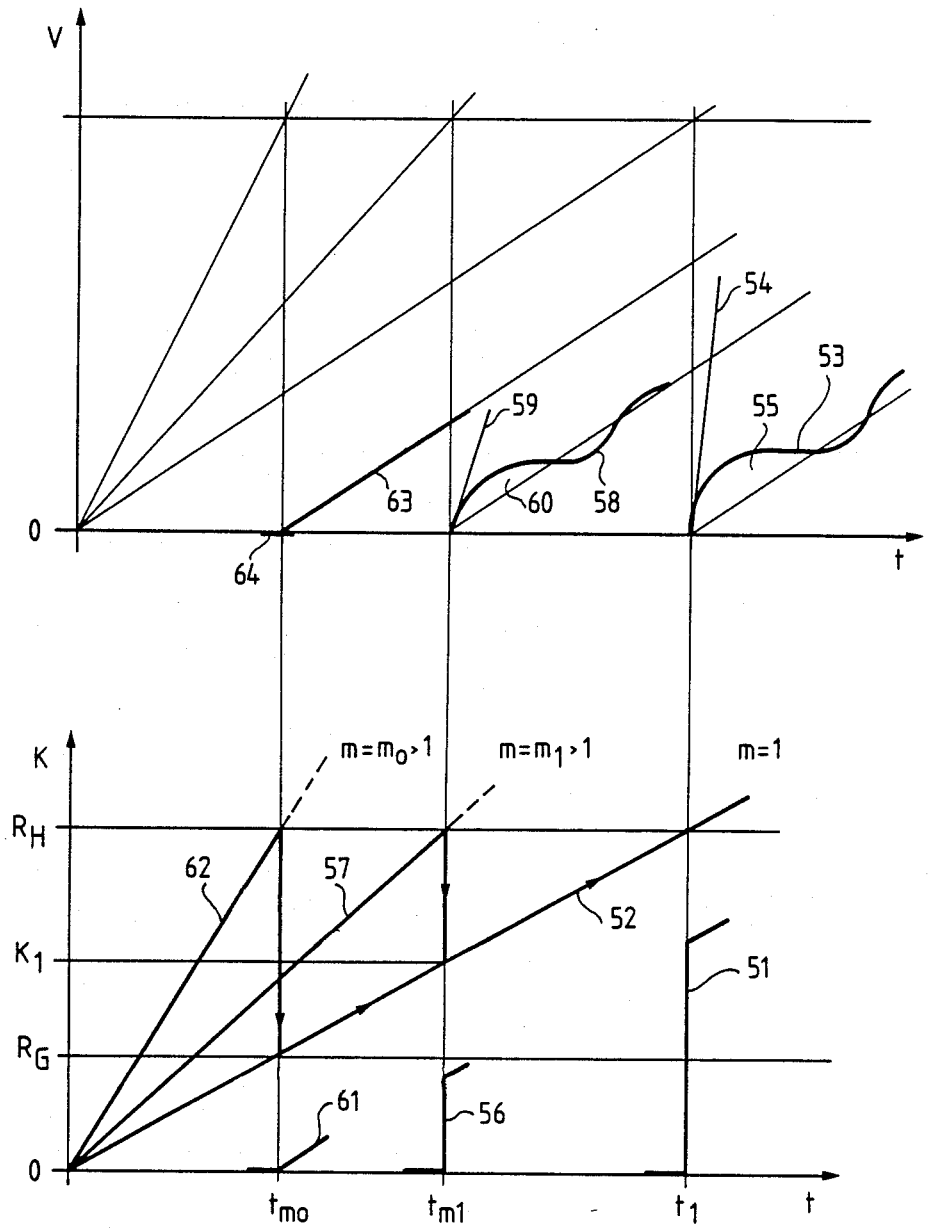
FIG. 4 is a diagram of the driving force and the car velocity plotted against time for the elevator drive according to the invention shown in FIG. 3, where the friction jerk is completely eliminated by optimum choice of the multiplication factor (m)
Figure 5:
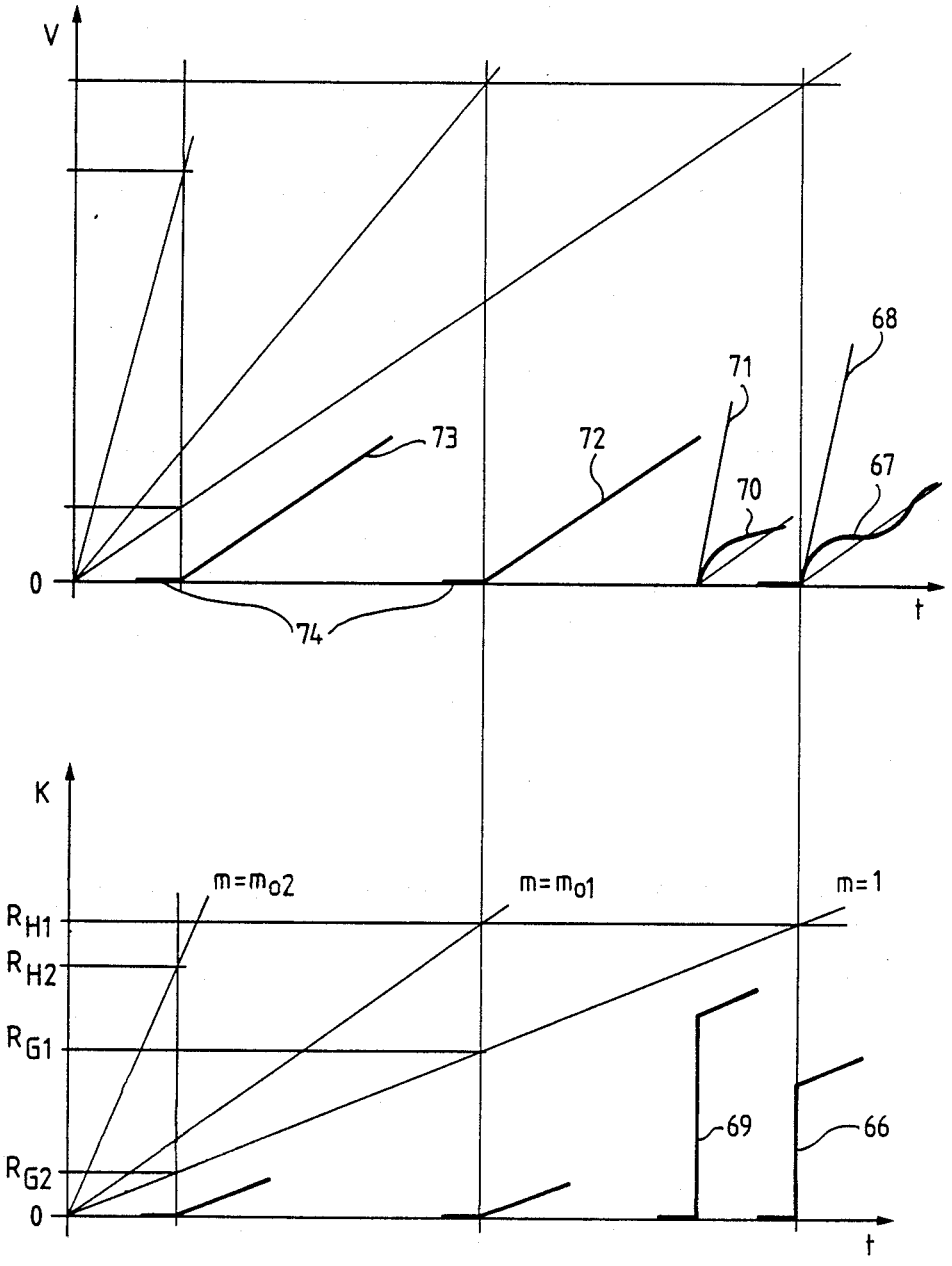
FIG. 5 is a diagram of the driving force and the car velocity plotted against time for the elevator drive according to the present invention shown in FIG. 3, where the friction jerk is completely eliminated at arbitrary friction conditions $R_H$ and $R_G$.
Figure 6:
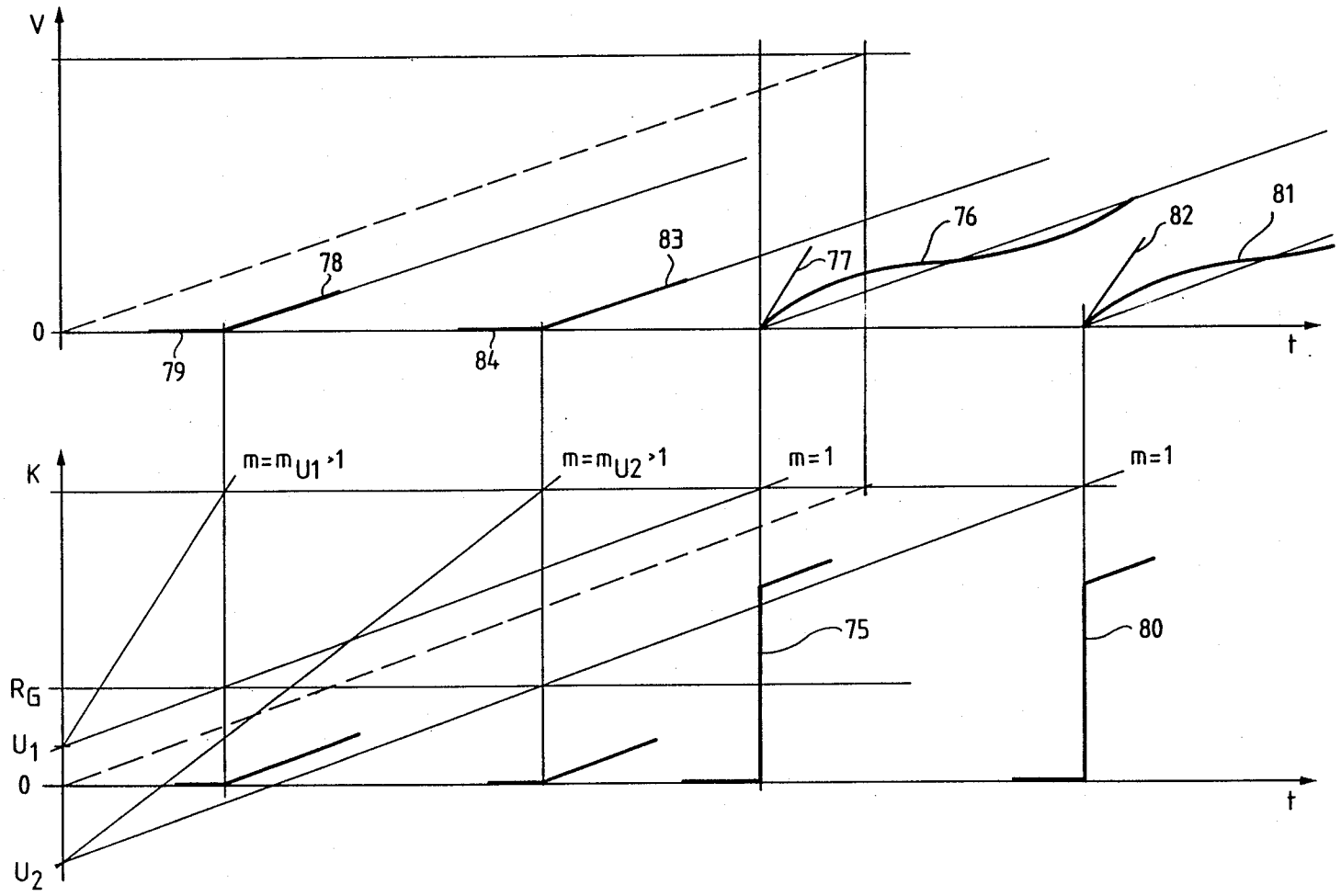
FIG. 6 is a diagram of the driving force and the car velocity plotted against time for the elevator drive according to the present invention shown in FIG. 3, where the friction jerk is completely eliminated at arbitrary imbalances $U_1$ and $U_2$.

Diagrams, which relate to the control device according to the invention as shown in FIG. 3, of force and velocity plotted against time are presented in FIGS. 4, 5 and 6. From this it is evident that the jerk due to friction can be suppressed completely in both directions of travel (FIG. 4), for all conditions of frictions (FIG. 5), and for all loads (FIG. 6).

FIG. 4 shows the progress in time of the driving forces as well as the associated start-up curves at no, at partial and at total suppression of jerks. Here again the static friction is designated by $R_H$, the sliding friction by $R_G$ and it is assumed that the car and the counterweight are balanced. If the multiplication factor "m" has the value of one, then the suppression of jerks is not effective, so that at the time $t_1$, the resulting driving force 51 and the start-up curve 53 yield the start-up tangent 54. At $m=m_1$ greater than one, the corresponding designations at time $t_{m1}$ are driving force 56, start-up curve 58 and tangent 59. At $m=m_o$ greater than one, the instability in the resulting driving force 61 is completely eliminated, so that the corresponding start-up curve 63 at the time $t_{mo}$ exhibits a horizontal start-up tangent 64.

It is illustrated in FIG. 5 how the jerk suppression according to the invention can be matched to different friction conditions typical in elevator installations. Two states of friction are being distinguished, which are characterized by their pertinent static and sliding friction values $R_{H1}$, $R_{G1}$ and $R_{H2}$, $R_{G2}$. A total suppression of jerks is attained at $R_{H1}$, $R_{G1}$ with $m=m_{o2}$ where the start-up curves 72 and 73 respectively result, both with horizontal start-up tangent 74.

Furthermore, it is evident from FIG. 6 that the suppression of jerks according to the invention is equally effective in both directions of travel for all loads. Again, the static friction is designated with $R_H$ and the sliding friction with $R_G$. At an imbalance $U_1$ in the direction of travel there results from $m=1$ (suppression of jerk ineffective) the start-up jerk 75, the start-up curve 76 as well as the start-up tangent 77 and, from a set point value multiplication $m=m_{U1}$ greater than one, the start-up curve 78 with the horizontal start-up tangent 79. At an imbalance $U_2$ against the direction of travel the corresponding diagrams are designated with 80, 81, 82, 83 and 84 respectively.

An expanded, general development of the jerk suppression according to the invention becomes evident from the block diagram of FIG. *7a*. As an addition to the embodiment shown in FIG. 3, three set point/actual value feedback circuits 85, 86 and 87 are provided with controllers 88, 89 and 90 , each comprising a set point value multiplier or amplifier 39. The on/off circuit 46 also acts through a multiplier 91, which increases the velocity set point value by way of the controller 90 in the outermost feedback circuit temporarily by the multiplication factor "m". As an alternative, the multiplier 91 can also be connected to the controller 88 or the controller 89. The controller 89 corresponds to the controller 45 in FIG. 3 and the controller 88 receives feedback from the hoisting motor 2. FIG. *7b* shows a comparison of customary start-up curves with suppression of jerks obtainable according to the invention, as per FIG. *7a*. In this diagram, a continuous curve is assumed, as is generally known from practice. Specified for customary drive controls are a set point start-up curve 92, which leads to an actual start-up curve 93 with a start-up time of $t_2$ and a transient built-up 94. Contrary to this is the set point start-up curve 95 with the suppression of jerks according to FIG. *7a*. The curve 95 follows during the first seven time increments a correction curve 96, and is therefore increased during a short interval 97 and decreased along a curve 98 at the transition from static to sliding friction, wherefrom the desired actual start-up curve 99 will result, which has an earlier start-up time $t_3$ and which does exhibit a transient build-up at a horizontal start-up tangent 100. For an explanation of the manner of functioning of the suppression of jerks according to the invention, reference shall be made to FIGS. 1 through *7b* and assumed that an elevator car 7 in an elevator shaft 9 shall be set into motion from standstill by means of a speed controlled drive.

First of all the conditions of prior art drive controls without the suppression of jerks according to the present invention are presented in the FIGS. 1 and 2, so that the character and the disadvantages of the start-up jerk are clearly apparent. Triggered by the operating control 21, the drive 1 will start where, for simplification a linear rise of the motor driving force according to diagram 26 will be assumed. Starting from a perfectly balanced load, the motor driving force 26 reaches at time $t_G$ the static friction force $R_H$, which at the beginning of the movement assumes suddenly the value of the sliding friction $R_G$, so that the difference between the motor driving force 26 and the sliding friction force $R_G$ will become effective as the resultant driving force 28 and, due to its instability at the time $t_G$, will lead to a start-up tangent 34 and a transient oscillation 35. From the start of the motion at time $t_G$, the tachometer pulses, which in each case correspond to a certain travel distance, are counted in the distance counter 22 and generate at the output of the set point value memory 14 corresponding set point velocity values. These values are compared in the controller with the actual velocity value, corresponding to the frequency of the tachometer pulses. Depending on the result, either a driving torque is generated in the motor through phase chopping by way of the three phase controller 12, or the slow travel winding of the motor is supplied with direct current by way of the phase controlled rectifier 13, so that a retarding torque is created due to the eddy current effect. Starting from a linear nominal start-up curve 27, this start-up process leads to an actual start-up curve 29 with a start-up tangent 34 and transient oscillation 35. At an imbalance $U_1$ in the direction of travel, the corresponding diagrams are designated with 30, 31, 34 and 35; and at an imbalance $U_2$ against the direction of travel they are designated with 32, 33, 34 and 35. In all three cases, there result similar set point start-up curves 29, 31, 33 which on account of equal unbalances of the driving forces 28, 30, 32 also exhibit equal start-up tangents 34 and equal transient oscillations 35, but which, due to the different equalization of the load by the counterweight, have different start-up times $t_G$, $t_{U1}$ and $t_{U2}$ respectively.

The function of the control device for jerk-free start-up shall now be explained in detail with the aid of the FIGS. 3, 4, 5, 6, 7*a* and 7*b*. First of all, it should be considered that according to the characterization of the invention, the specified mechanical start-up jerk is eliminated by control. Thus, in the block diagram of FIG. 3, two control circuits are recognizable; control circuit 49 for the suppression of jerks as well as control circuit 50 for the regular speed control. Of importance is that the suppression of jerks according to the invention, as well as the control of the speed of revolution of the pulley 6 do not take place simultaneously but successively: the suppression of jerks in the time interval from start to and with the beginning of motion, and the control of speed from the beginning of motion up to the end of the controlled rotation of the pulley. Based on this separation in time, the circuit elements 14, 39, 40, 42, 45, 12, 2, and 16 are utilized by both control circuits 49 and 50 in time multiplexed fashion.

The basic control process for regulating or smoothing the jerk at start-up is described with the aid of FIGS. 3 and 4. The drive starts with the operating control 21 calling for a first set point input from the set point memory 14 and by setting the multiplication factor "m" of the set point multiplier 39 by way of the on/off circuit 46 to a value greater than one. The first set point value increased in this manner acts by way of the digital-analog converter 40, the comparator 42, the PI-controller 43 as well as the three phase controller 12 on the hoisting motor 2, where a motor driving force is generated which runs up depending on the chosen multiplication factor "m" along the linearly assumed diagrams 52, 57 and 62. When the motor driving force exceeds the static friction force $R_H$, movement will begin. The digital tachometer 16, which also serves as a motion detector, detects this motion after a few hundred millimeters of movement of the drive pulley and thereby switches the on/off circuit 46 to "off" by way of the stop input 48, and thus the multiplying factor "m" is changed back to one. This cycle can be traced in FIG. 4 as follows: at $m=1$, that is at no jerk suppression, the motor driving force runs up along the straight line 52. The beginning of the movement takes place at time $t_1$, where the friction force, at unchanged increasing motor driving force 52, decreases suddenly from the static friction $R_H$ to the sliding friction $R_G$. The resulting driving force 51 exhibits therefore a discontinuity with the amplitude $R_H$-$R_G$, which causes the highest possible friction jerk and leads to the start-up curve 53 with the start-up tangent 54 and transient oscillation 55.

At $m=m_1$ greater than one, the motor driving force no longer proceeds rising monotonically, but its progress will be switched over for the purpose of suppression of jerks at the time $t_{m1}$ from the initial diagram 57, to the diagram 52. The resulting driving force 56 exhibits at the time $t_{m1}$ a discontinuity with the reduced amplitude $K_1$-$R_G$. Although the friction jerk is thereby only partially suppressed, the results from this in comparison to the conditions with $m=1$ are an improved start-up curve 58 with a less steep start-up tangent 59 and a reduced transient oscillation 60. At $m=m_o$ greater than one, the progress of the motor driving force at the beginning of the movement, that is at the time $t_{mo}$, is switched over from the initial diagram 62 to the diagram 52 and the motor driving force is reduced by the amount $R_H$-$R_G$. The sudden reduction of the friction force at the time $t_{mo}$ from $R_G$ to $R_G$ is therefore completely neutralized by an equally large and approximately equally rapid reduction of the motor driving force. The associated multiplication factor $m_o$ is therefore an optimum with respect to the suppression of the jerk. The resulting driving force 61, at the time $t_{mo}$, no longer exhibits any discontinuity so that the friction jerk is completely suppressed and a start-up curve 63 with a horizontal start-up tangent 64 without transient oscillation is present.

It is furthermore illustrated in FIG. 5, how with the present invention a complete suppression of jerks is attained at arbitrary conditions of friction $R_H$ and $R_G$. For first values of friction $R_{H1}$, $R_{G1}$ and no suppression of jerks ($m=1$), there appear the resultant driving force 66, as well as the start-up curve 67 with the start-up tangent 68. Now we set $m=m_{o1}$, which completely eliminates the start-up jerk according to the diagrams 72 and 74. For arbitrary further values of friction $R_{H2}$, $R_{G2}$, the suppression of jerks takes place in an analogous manner. For this, it is only necessary to choose the multiplication factor "m" correspondingly, that is to set it equal to $m_{o2}$. The associated diagrams are marked with 73 and 74. By appropriate choice of the multiplication factor "m", the control device for jerk-free start-up according to the invention, can therefore be matched to all conditions of frictions typical in elevator installations.

Finally, it is shown in FIG. 6 how, with the present invention, the start-up jerk can be suppressed at arbitrary loads and in both directions of travel. Since in this general case no complete load equalization by the counterweight exists, two imbalances $U_1$ and $U_2$ are assumed; $U_1$ in the direction of travel and $U_2$ acting opposite to the direction of travel. For $m=1$, that is no suppression of jerk, the resultant driving force as well as the start-up curves progress as shown in diagrams 75, 76 and 77 at $U_1$, respectively 80, 81 and 82 at $U_2$. In both cases, the start-up jerk is a maximum with the amplitude $R_H$-$R_G$. This start-up jerk is in both cases completely suppressed by the appropriate choice of the multiplying factor "m". With $m=m_{U1}$ and $m=m_{U2}$, there results the desired start-up curves 78 and 83 both with horizontal start-up tangents 79 and 84 respectively.

Figure 7A:
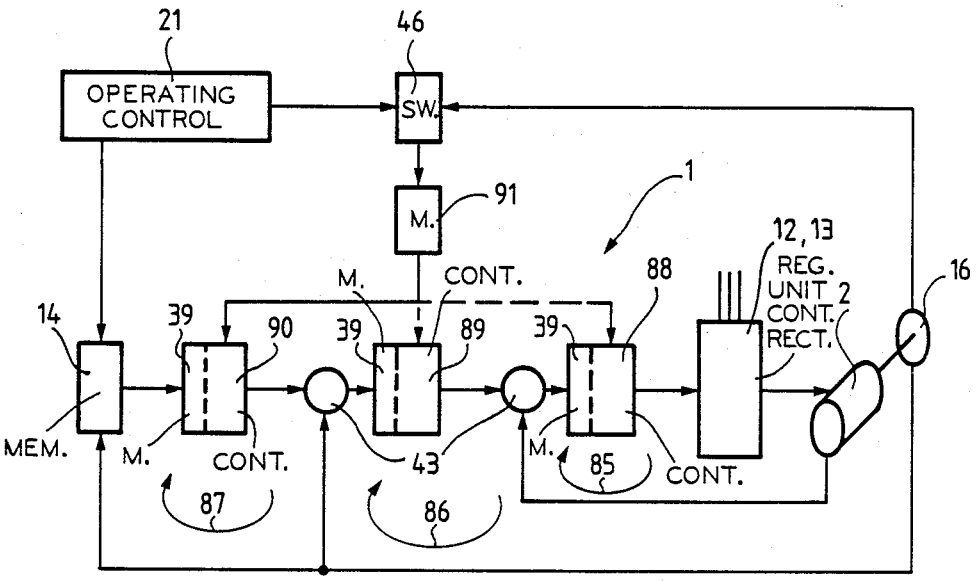
FIG. 7*a* is a block diagram and partial schematic representation of an elevator drive, equipped with the control device for the jerk-free start-up according to the invention, with three set point/actual value feedback circuits and integrated set point value multipliers.
Figure 7B:
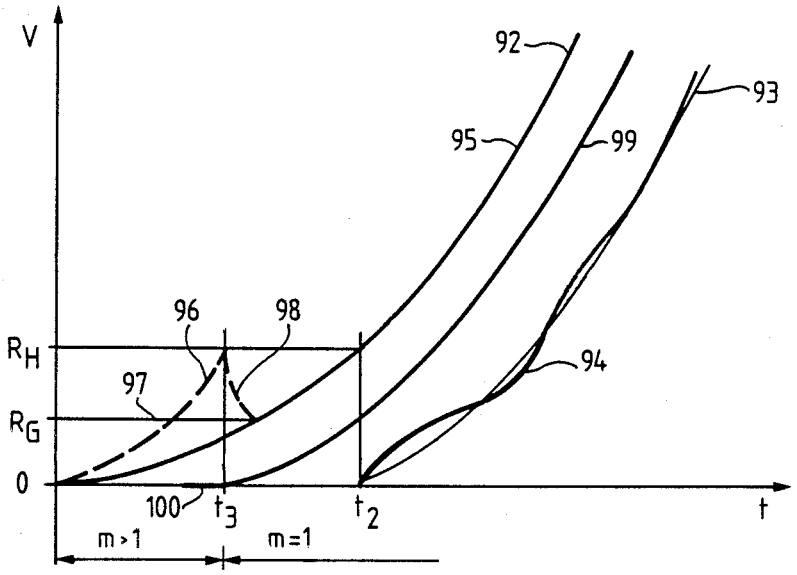
FIG. 7*b* is a diagram of the trend of the set point and actual start-up curves V=F(t) for the velocity in the elevator drive according to the invention shown in FIG. 7*a*.

In each of the drive controls shown in FIGS. 3 and 7*b*, the multiplier is an integral component of the drive control and can be adjusted to a selected multiplication factor greater than one. The multiplication factor value can be selected as a function of the car load and/or as a function of the elevator system friction.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator drive control apparatus for jerk-free start-up in an elevator system, the elevator system including a hoisting motor coupled with a drive pulley for moving an elevator, a tachometer responsive to the rotation of the pulley for generating an output signal representing the speed and the distance travelled for the car, and a drive control for car velocity having a set point memory responsive to the output signal for generating a speed set point signal, a comparator responsive to the set point signal and the output signal for generating a comparator output signal, and a controller responsive to the comparator output signal for controlling the speed of rotation of the hoisting motor and the pulley, the elevator control apparatus comprising:

a set point multiplier connected between a set point memory and a comparator in an elevator system for multiplying the value of a set point signal generated by the set point memory by a selected multiplication factor; and an on/off switching circuit connected between a tachometer and said set point multiplier for switching said multiplication factor from a value of one to a value greater than one prior to the start of movement of an associated elevator car and switching back to a value of one at the beginning of movement of the car whereby at the start of movement of the associated elevator car, the sum of the resultant hoisting motor driving force and the imbalance force is equal to the sliding friction force.

2. The elevator drive control apparatus for jerk-free start-up according to claim 1 wherein the tachometer is a high resolution digital tachometer of the incremental transmitter type for generating a pulsed output to said on/off switching circuit.

3. The elevator drive control apparatus for jerk-free start-up according to claim 2 wherein said on/off switching circuit switches back to a value of one in response to said pulsed output from the tachometer.

4. The elevator drive control apparatus for jerk-free start-up according to claim 1 wherein said set point multiplier is an amplifier.

5. The elevator drive control apparatus for jerk-free start-up according to claim 1 wherein said set point multiplier is an integral component of the drive control for car velocity.

6. The elevator drive control apparatus for jerk-free start-up according to claim 1 wherein the selected multiplication factor can be adjusted to a selected value greater than one.

7. The elevator drive control apparatus for jerk-free start-up according to claim 1 wherein said on/off switching circuit, in the time interval prior to the start of the car movement, determines the instant at which the multiplication factor is switched to greater than one.

8. The elevator drive control apparatus for jerk-free start-up according to claim 1 wherein the on/off switching circuit responds to a travel signal from an operating control by switching the multiplication factor, prior to the start of the car movement, to a value greater than one.

9. The elevator drive control apparatus for jerk-free start-up according to claim 1 wherein the multiplication factor is selected as a function of the car load.

10. The elevator drive control apparatus for jerk-free start-up according to claim 1 including a plurality of set point/actual value feedback circuits wherein the switching of the multiplication factor takes place in the outermost one of said set point/actual value feedback circuits.

11. In an elevator system for jerk-free start-up of an elevator car including a hoisting motor coupled to a drive pulley for moving an elevator car, a tachometer responsive to the rotation of the pulley for generating a signal representing the speed of rotation of the pulley, a controller for controlling the hoisting motor in response to a set point signal and the tachometer signal, and a set point memory for generating the set point signal in response to the tachometer signal and a control signal from an operating control, the improvement comprising:

a set point signal multiplier means connected between the set point memory and the controller for the hoisting motor for multiplying a set point signal generated by the set point memory by a selected multiplication factor; and an on/off switching circuit having inputs connected to outputs of the operating control and the tachometer and an output connected to an input of said multiplier means for generating a first signal prior to the start of movement of the elevator car and for generating a second signal subsequent to the start of movement of the elevator car, said multiplier means being responsive to said first signal for switching from a multiplication factor of one to a multiplication factor greater than one and responsive to said second signal for switching back to a multiplication factor of one.

12. An elevator drive control apparatus for jerk-free start-up of an elevator car in an elevator system comprising:

a hoisting motor driving a pulley for moving an elevator car;

a tachometer responsive to the movement of said pulley for generating a tachometer signal representing the actual velocity and the distance travelled for an associated elevator car;

an operating circuit for generating starting and stopping signals;

a set point memory responsive to said starting and stopping signals and to said tachometer signal for generating a set point signal;

a controller responsive said set point signal and said tachometer signal for controlling said hoisting motor;

a multiplier connected between said set point memory and said controller for multiplying said set point signal by a selected multiplication factor from one to a predetermined value greater than one; and an on/off switching circuit responsive to said tachometer signal and said starting and stopping signals for controlling said multiplier to switch said multiplication factor from one to a selected value greater than one when said starting signal is generated and switching said multiplication factor back to one when said tachometer signal indicates movement, said selected value causing said hoisting motor to generate a driving force which is combined with any imbalance force to equal the sliding friction force.

* * * * *